US006937129B2

(12) United States Patent
Hsueh et al.

(10) Patent No.: US 6,937,129 B2
(45) Date of Patent: Aug. 30, 2005

(54) TRANSFORMER

(75) Inventors: Ching-Fu Hsueh, Taoyuan (TW); Wan-Chin Hsu, Taoyuan (TW); Chih-Shin Huang, Taoyuan (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 10/826,827

(22) Filed: Apr. 16, 2004

(65) Prior Publication Data

US 2004/0212476 A1 Oct. 28, 2004

(30) Foreign Application Priority Data

Apr. 22, 2003 (TW) ..... 92109324 A

(51) Int. Cl.[7] ..... H01F 27/30
(52) U.S. Cl. ..... 336/208; 336/198; 336/212
(58) Field of Search ..... 336/212, 208, 336/198

(56) References Cited

U.S. PATENT DOCUMENTS

| | | | | | |
|---|---|---|---|---|---|
| 3,947,749 | A | * | 3/1976 | Kimura et al. | 363/126 |
| 4,307,334 | A | * | 12/1981 | Peil et al. | 323/351 |
| 6,580,264 | B2 | * | 6/2003 | Nekado | 324/207.16 |
| 2005/0073385 | A1 | * | 4/2005 | Wu et al. | 336/208 |

FOREIGN PATENT DOCUMENTS

| | | | | | |
|---|---|---|---|---|---|
| JP | 359189613 | A | * | 10/1984 | H01F/31/00 |
| JP | 200277360 | A | * | 3/1999 | H01F/30/00 |
| JP | 2002 25835 | A | * | 1/2002 | H01F/27/24 |

* cited by examiner

*Primary Examiner*—Anh Mai
(74) *Attorney, Agent, or Firm*—Quintero Law Office

(57) ABSTRACT

A transformer. The transformer includes an iron core, a first bobbin, a second bobbin, a primary coil and a secondary coil. The first bobbin surrounds the iron core, and the second bobbin surrounds the first bobbin. The secondary coil is wound on the second bobbin, and the primary coil comprises a first coil section and a second coil section wound on the first bobbin, wherein the coil winding density of the first coil section exceeds the second coil section.

6 Claims, 7 Drawing Sheets

TRANSFORMER

BACKGROUND OF THE INVENTION

1. Field of the Invention

The present invention relates to a transformer and in particular to a transformer with different coil winding densities.

2. Description of the Related Art

Referring to FIG. 1, a conventional transformer 1 has two E-shaped iron cores 12 combined to form a closed magnetic loop. Further, the conventional transformer 1 has a bobbin 10 divided into a primary winding window 101 and several secondary winding windows 102 by the flanges 11. The secondary winding windows 102 are formed to prevent arcing faults due to high voltage difference between two adjacent layers of coils. A plurality of pins 103 are disposed at both ends of bobbin 10 for connecting the wire of the coils to a circuit board (not shown).

As the primary and secondary winding windows 101, 102 are disposed at different positions of the same bobbin 10, it is difficult to achieve a high coupling ratio due to the long distance therebetween. Referring to FIG. 2*a*, another conventional transformer 2 is provided with a first bobbin 21 with two E-shaped iron cores 23 passing therethrough, and a second bobbin 22 enclosing the first bobbin 21. A plurality of pins 211, 221 are respectively disposed on the first and second bobbins 21, 22 for connecting the wire wound thereon. Referring to FIGS, 2*b* and 2*c*, a primary coil 212 is evenly wound on the first bobbin 21, and a secondary coil 222 is evenly wound on the second bobbin 22 with a plurality of flanges 223 disposed thereon for preventing arcing faults.

As shown in FIG. 2*d*, the distance between the primary and secondary coils 212 and 222 is small, and the coils overlap such that the transformer 2 achieves excellent coupling ratio. The transformers, however, must be capable of achieving appropriate coupling ratios to meet specific electrical circuit requirements.

SUMMARY OF THE INVENTION

Accordingly, an object of the present invention is to provide a transformer with different coil winding densities. The transformer includes an iron core, a first bobbin, a second bobbin, a primary coil and a secondary coil. The first bobbin surrounds the iron core, and the second bobbin surrounds the first bobbin. The secondary coil is wound on the second bobbin, and the primary coil comprises a first coil section and a second coil section wound on the first bobbin, wherein the coil winding density of the first coil section exceeds the second coil section.

DESCRIPTION OF THE DRAWINGS

The present invention can be more fully understood by reading the subsequent detailed description in conjunction with the examples and references made to the accompanying drawings, wherein.

DETAILED DESCRIPTION OF THE INVENTION

Figure 1:
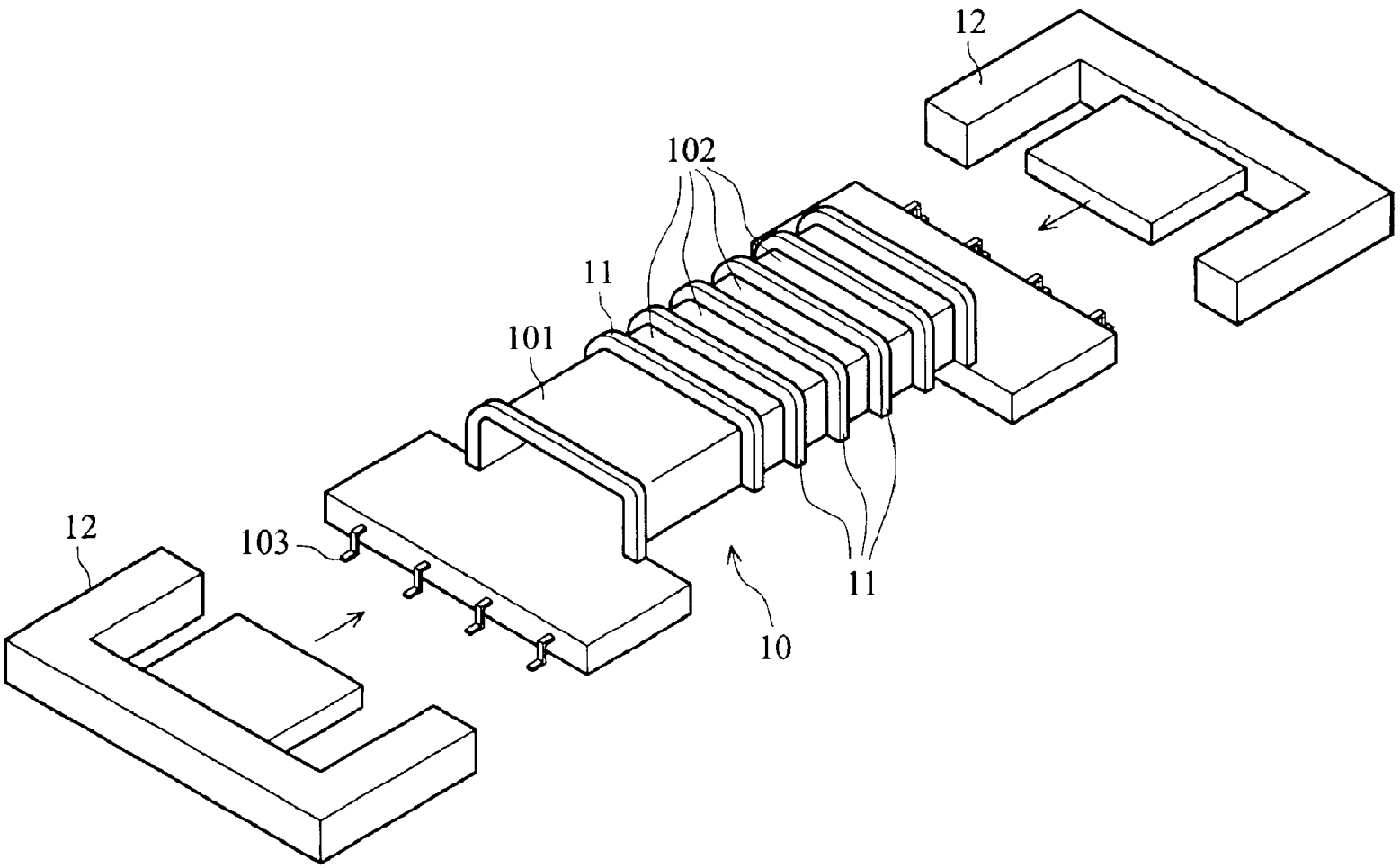
FIG. 1 (RELATED ART)
FIG. 1 is a perspective diagram of a conventional transformer.
Figure 2A:
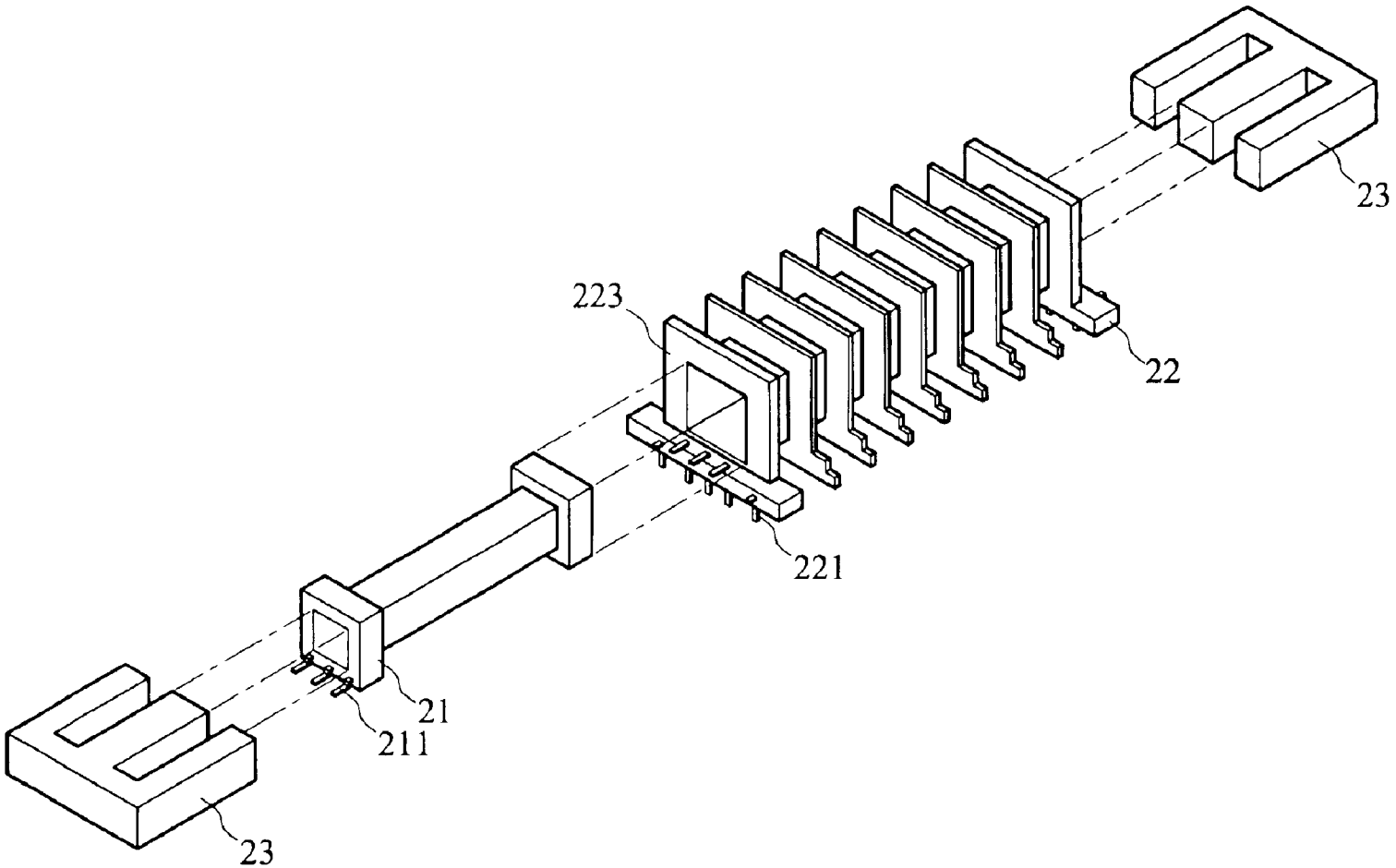
FIG. 2a (RELATED ART)
FIG. 2*a* is a perspective diagram of another conventional transformer.
Figure 2C:
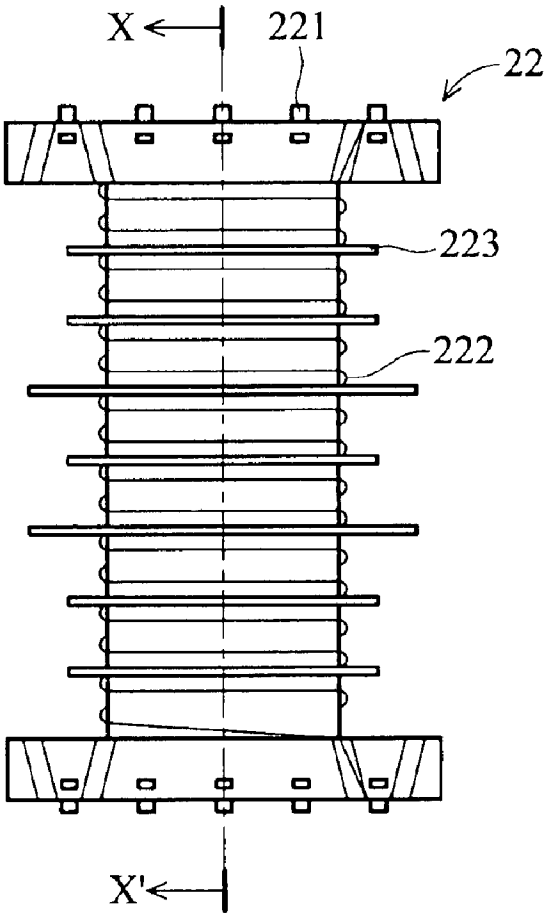
FIG. 2c (RELATED ART)
FIG. 2*c* is a perspective diagram of a secondary coil wound on the second bobbin according to FIG. 2*a;*
Figure 2B:
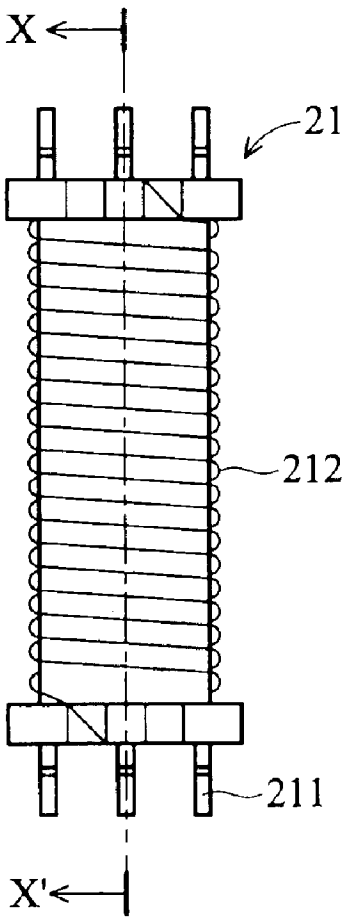
FIG. 2b (RELATED ART)
FIG. 2*b* is a perspective diagram of a primary coil wound on the first bobbin according to FIG. 2*a;*
Figure 2D:
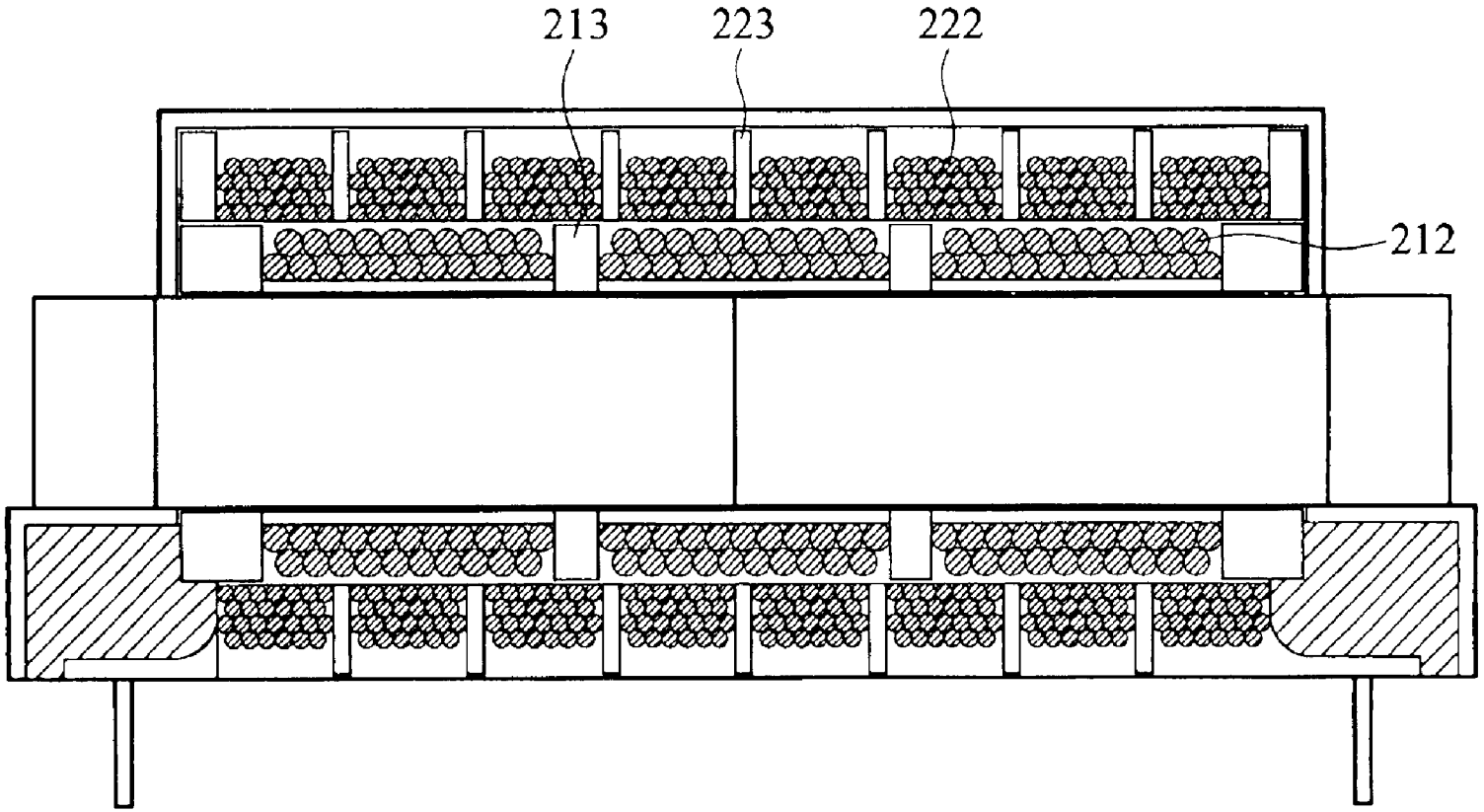
FIG. 2d (RELATED ART)
FIG. 2*d* is a cross-section of X–X'based on FIGS. 2*b*, 2*c* when the first and second bobbins are combined.
Figure 3B:
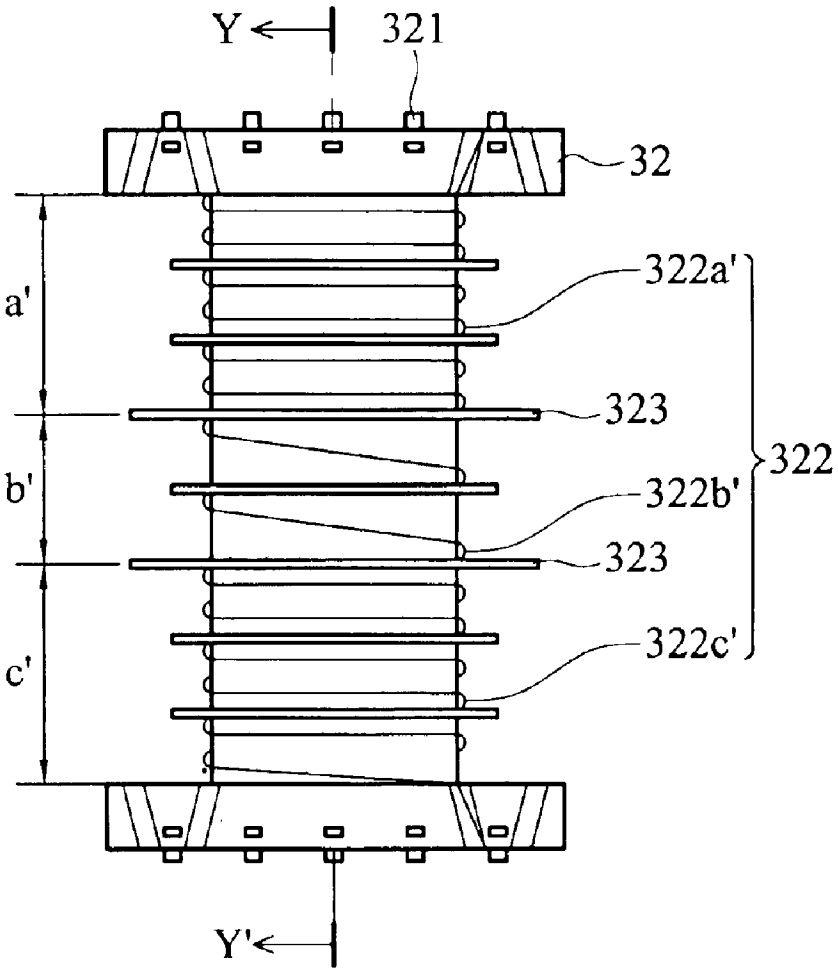
FIG. 3*b* is a perspective diagram of the secondary coil wound on the second bobbin in accordance with the present invention.
Figure 3A:
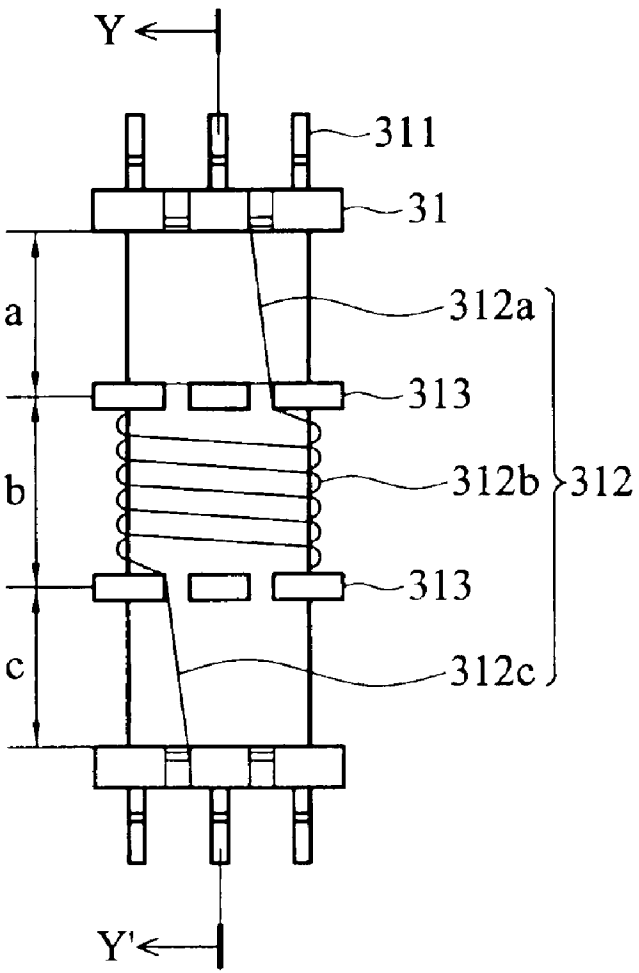
FIG. 3*a* is a perspective diagram of the primary coil wound on the first bobbin in accordance with the present invention.

Referring to FIGS. 3*a* and 3*b*, a first bobbin 31 has a plurality of primary coil windows a, b and c divided by the flanges 313. A primary coil 312 connects the pins 311 at both ends of the first bobbin 31 dividing it into three coil sections 312*a*, 312*b* and 312*c* correspondingly located in the primary coil windows a, b and c. The coil winding densities of the coil sections 312*a*, 312*b* and 312*c* are different. As shown in FIG. 3*a*, only the coil section 312*b* is wound in the primary coil window b of the first bobbin 31.

In FIG. 3*b*, the second bobbin 32 has a plurality of secondary coil windows a', b' and c' divided by the flanges 323. A secondary coil 322 connects the pins 321 at both ends of the second bobbin 32 dividing it into three coil sections 322*a*', 322*b*' and 322*c*' correspondingly located in the secondary coil windows a', b' and c'. As shown in FIG. 3*b*, the coil winding densities of the coil sections 322*a*' and 322*c*' exceed the coil section 322*b'*.

Figure 3C:
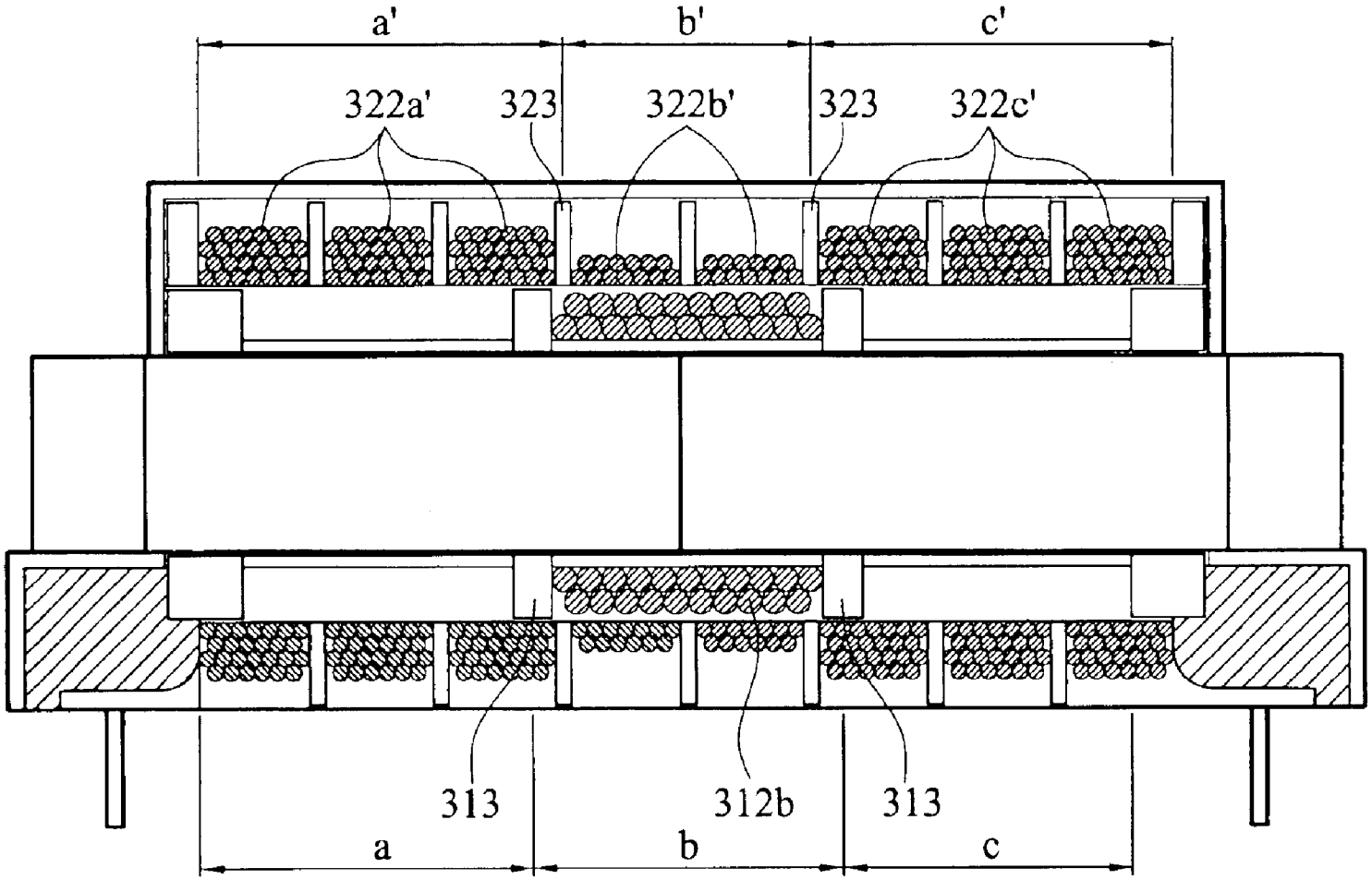
FIG. 3*c* is a cross-section of Y–Y' based on FIG. 3*a*, 3*b* wherein the first and second bobbins are combined in accordance with the present invention.

Referring to FIG. 3*c*, the second bobbin 32 is disposed surrounding the first bobbin 31 and the secondary coil 322 encloses the primary coil 312. In the present invention, the primary coil windows a, b and c are arranged corresponding to the secondary coil windows a', b' and c' such that the coil sections 312*a*, 312*b* and 312*c* are located corresponding to the coil sections 322*a*', 322*b*' and 322*c'*.

As mentioned, the primary coil 312 and the secondary coil 322 can be divided into several coil sections (312*a*, 312*b*, 312*c*, 322*a*', 322*b*' and 322*c*') with different coil winding densities such that the transformer is adjustable and able to achieve an appropriate coupling ratio between the coils 312, 322 for application in a specific electric circuit. According to the present invention, the number of coil sections and the coil winding densities thereof can be predetermined and easily adjusted, and as such are suitable for use in various circuits.

Figure 4:
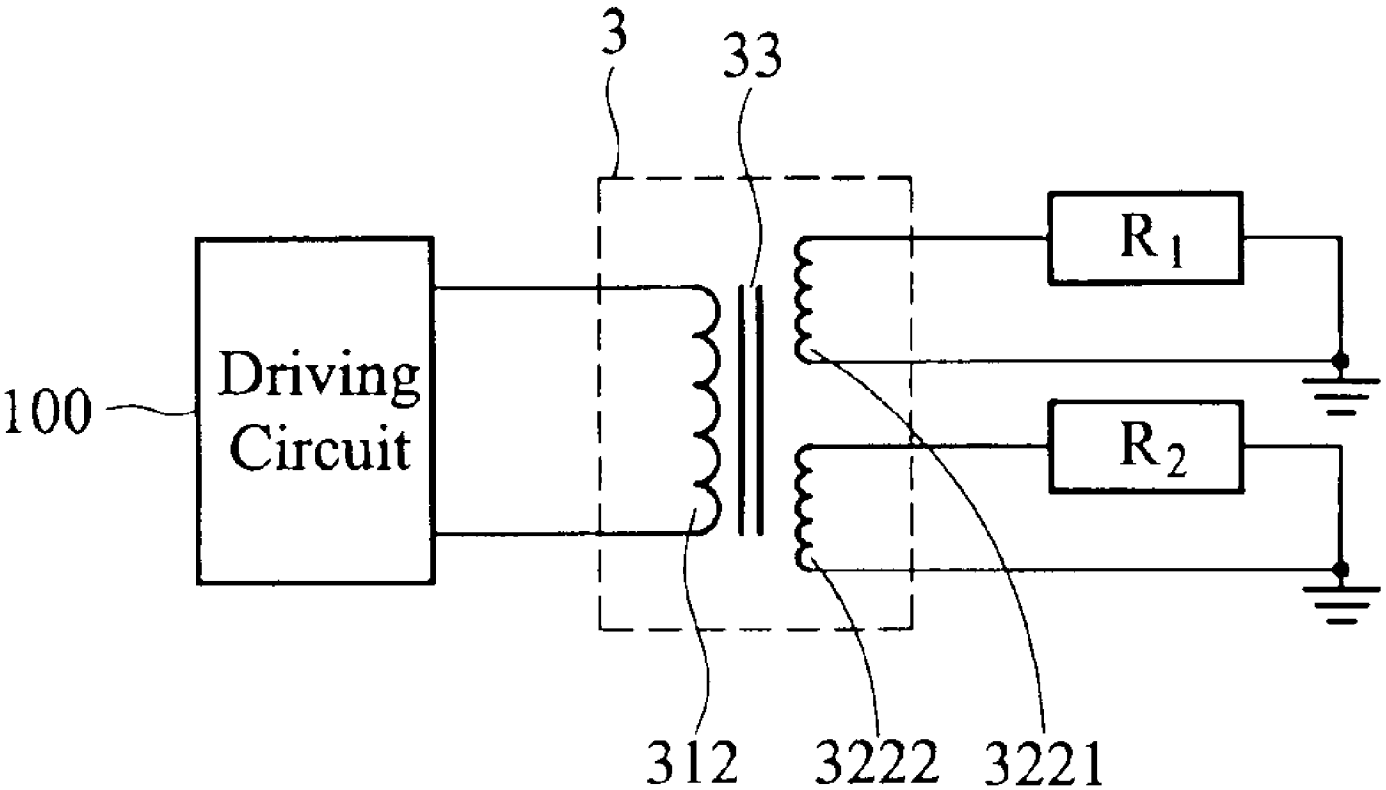
FIG. 4 is a perspective diagram of the transformer applied to a power supply circuit for a multi-lamp system.

As shown in FIG. 4, the present invention can be applied to a power supply circuit for a multi-lamp system of an LCD display. The transformer 3 has an iron core 33 forming a closed magnetic loop. The primary coil 312 of the transformer 3 connects a driving circuit 100 such as a Royer, MPS, 02 or Linfinity circuit. Two independent secondary coils 3221, 3222 of the transformer 3 connect the lamps R1 and R2 respectively. If the driving circuit 100 such as an MP2, O2 or Linfinity circuit requires a transformer with lower coupling ratio, the coil winding densities of the primary coil 312 and secondary coils 3221, 3222 are lowered to achieve the required coupling. Similarly, if the driving circuit 100 such as a Royer circuit requires transformer capable of higher coupling ratio, the overlap area and the coil winding densities of the primary coil 312 and secondary coils 3221, 3222 can be adjusted and increased to achieve adequate coupling according to the present invention. In summary, the coil winding densities of primary and secondary coils are adjustable enabling appropriate coupling ratio for a specific circuit. Thus, the transformer of the present invention is suitable for different circuits.

Finally, while the invention has been described by way of example and in terms of the preferred embodiments, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A transformer comprising:

an iron core;

a first bobbin surrounding the iron core;

a second bobbin surrounding the first bobbin;

a secondary coil wound on the second bobbin;

a primary coil comprising a first coil section and a second coil section wound on the first bobbin, wherein the coil winding density of the first coil section exceeds the second coil section.

2. The transformer as claimed in claim 1, wherein the first bobbin has a protrusion separating the first and second coil sections.

3. The transformer as claimed in claim 1, wherein the secondary coil comprising a third coil section and a fourth coil section wound on the second bobbin, wherein the coil winding density of the fourth coil section exceeds the third coil section.

4. The transformer as claimed in claim 3, wherein the second coil section is arranged corresponding to the fourth coil section.

5. The transformer as claimed in claim 3, wherein the first coil section is arranged corresponding to the third coil section.

6. The transformer as claimed in claim 2, wherein the first bobbin has a protrusion separating the third and fourth coil sections.

* * * * *